US005540072A

United States Patent [19]

Nishimura

[11] Patent Number: 5,540,072

[45] Date of Patent: Jul. 30, 1996

[54] ECCENTRIC ROLLER CONTROL APPARATUS

[75] Inventor: Yoichi Nishimura, Fuchu, Japan

[73] Assignee: Kabushiki Kaisha Toshiba, Kawasaki, Japan

[21] Appl. No.: 220,468

[22] Filed: Mar. 31, 1994

Related U.S. Application Data

[63] Continuation of Ser. No. 865,228, Apr. 8, 1992, abandoned.

[30] Foreign Application Priority Data

Apr. 10, 1991 [JP] Japan ..... 3-077817

[51] Int. Cl.[6] ..... B21B 37/08

[52] U.S. Cl. ..... 72/10.4; 72/10.1

[58] Field of Search ..... 72/8, 11, 21; 100/47; 364/472

[56] References Cited

U.S. PATENT DOCUMENTS

| | | | |
|---|---|---|---|
| 3,893,317 | 7/1975 | Clarke | 72/20 |
| 4,580,224 | 4/1986 | Gerber | 364/472 |
| 4,648,257 | 3/1987 | Oliver et al. | 72/16 |
| 4,691,547 | 9/1987 | Teoh et al. | 72/16 |
| 4,843,854 | 7/1989 | Ackerly | 72/8 |
| 4,850,211 | 7/1989 | Sekiguchi et al. | 72/8 |
| 4,910,985 | 3/1990 | Ballyns | 72/21 |

FOREIGN PATENT DOCUMENTS

| | | | |
|---|---|---|---|
| 1028399 | 7/1983 | U.S.S.R. | 72/20 |

*Primary Examiner*—Lowell A. Larson
*Assistant Examiner*—Thomas C. Schoeffler
*Attorney, Agent, or Firm*—Foley & Lardner

[57] ABSTRACT

An eccentric roller control apparatus is intended to eliminate the adverse effect of the eccentric upper and lower back-up rollers against a product profile with high precision. The rolling weight sensors 7W, 7D sense each rolling weight of a working side and a driving side. The rotary angles of the upper back-up roller 4T and lower back-up roller 4B are sensed by the angle sensors 8T, 8B. The roller eccentricity sensor 14 serves to derive each of the amplitudes $A_{TWn}$, $B_{TWn}$, $A_{BWn}$, $B_{BWn}$, $A_{TDn}$, $B_{TDn}$, $A_{BDn}$ and $B_{BDn}$ as each roller eccentricity of the working side and the driving side, based on the sensed rolling weights $P_W$, $P_D$ and the rotary angles $\Theta_T$ and $\Theta_B$. Then, the depression operating unit 15W serves to derive the depression of the working side and add the derived value to the depressor control device 6W. The depression operating unit 15D serves to derive the depression of the driving side and add the derived value to the depressor control device 6D.

1 Claim, 4 Drawing Sheets

ECCENTRIC ROLLER CONTROL APPARATUS

This application is a continuation of application Ser. No. 07/865,228, filed Apr. 8, 1992, now abandoned.

BACKGROUND OF THE INVENTION

1. Field of the Invention

The present invention relates to an eccentric roller control apparatus which is capable of controlling a depressing position of a pair of upper and lower back-up rolls according to the eccentricity of the back-up rolls in order to eliminate the adverse effect caused by the eccentric back-up rolls.

2. Description of the Prior Art

FIG. 3 is a block diagram showing a conventional eccentric roller control apparatus connected to a normal rolling machine to be controlled by the apparatus itself.

As shown, a rolling machine 1 provides an upper working roller 3T and a lower working roller 3B for rolling a material 2, an upper back-up roller 4T and a lower back-up roller 4B provided outside of the rollers 3T and 3B, a depressor 5W for driving the side of the lower back-up roller 4B in such a manner to change a gap between the lower working roller 4B and the lower back-up roller 3B, and a depressor 5D for driving the driving side of the rollers 4B and 3B. The depressors 5W and 5D are controlled by depressor control devices 6W and 6D, respectively.

In order to eliminate the adverse effect caused by the eccentric rollers 4T and 4B, the depressing weights placed on the working side and the driving side are sensed by weight sensors 7W and 7D, respectively. The rotary angles of the upper roller 4T and the lower roller 4B are also sensed by angle sensors 8T and 8B, respectively. The sensed depressed weights are added to each other by a weight adder 11. The weight adder 11 outputs the added weights. An eccentricity sensor 12 serves to sense the eccentricity amounts of the upper and the lower back-up rollers 4T and 4B, based on the added weights and the rotary angle sensed by the angle sensors 8T and 8B. A depression operating unit 13 serves to operate the controlled depressing amount, based on the sensed eccentricity amounts and the rotary angles sensed by the sensors 8T and 8B.

FIG. 4 is a block diagram showing the eccentricity sensor 12. The sensor 12 is arranged to have a weight lock-on unit 121 for storing the added weights as being interlocked with the rotary angle of the lower back-up roller 4B and calculating an average value, a weight deviation operating unit 122 for calculating a deviation of this average value to the added weights before averaging, a weight-to-gap converter 123 for calculating a gap deviation corresponding to the calculated weighted deviation, and an eccentricity analyzing unit 124 for calculating an amplitude as the eccentricity of the roller according to the outputs of the angle sensors 8T and 8B.

Then, the description will be directed to the operation of the eccentric roller control apparatus.

When the rolling machine 1 operates to roll the material 2, assuming that one or both of the upper and the lower back-up rollers 4T and 4B are eccentric, the width of the material 2 is not made uniform. To eliminate the adverse effect caused by the eccentric rollers, the weight sensors 7W and 7D serve to sense the depressed weights of the working side and the driving side and the angle sensors 8T and 8B serve to sense the rotary angle of the upper and the lower back-up rollers 4T and 4B, respectively.

Based on the sensed signals of the weight sensors 7W and 7D, the weight adder 11 performs the following operation:

$$P=P_W+P_D \tag{1}$$

wherein P is an added weight [ton], $P_W$ is a depressed weight of the working side [ton], and $P_D$ is a depressed weight of the driving side [ton].

The eccentricity sensor 12 serves to calculate the amplitudes $A_{Tn}$ and $B_{Tn}$ [mm] of the eccentricity amount of the upper back-up roller 4T, based on the added weight P, the rotary angle $\Theta_T$ [rad] of the upper back-up roller 4T, and the rotary angle $\Theta_B$ [rad] of the lower back-up roller 4B.

In this case, the weight lock-on unit 121 composing the eccentricity sensor 12 serves to calculate an average value $P_L$ [ton] during one rotation of the lower back-up roller 4B from the starting point of the eccentricity amount in response to the added weight P and the rotary angle $\Theta_T$ of the lower back-up roller 4B. This average value $P_L$ is referred to as a lock-on value. The weight deviation operating unit 122 serves to obtain the weight deviation ΔP [ton] from the following expression, based on the added weight P and the lock-on value $P_L$.

$$\Delta P=P-P_L \tag{2}$$

The weight-gap converter 123 serves to calculate a gap deviation AS corresponding to the weight deviation ΔP by the following expression.

$$\Delta S=-(M+m).\Delta P/(M.m) \tag{3}$$

wherein M is a mill constant and m is a plastic coefficient.

The eccentricity analyzing unit 124 serves to accept this gap deviation AS, the rotary angles $\Theta_T$, $\Theta_B$ of the upper and the lower back-up rollers and perform the fast Fourier transformation with respect to the input values for deriving an amplitude $A_{Tn}$ (an n-degree cosine component) of the deviation of the eccentricity of the upper back-up roller 4T, an amplitude $B_{Tn}$ (n-degree sin component) [mm], and amplitudes $A_{Bn}$ and $B_{Bn}$ of the eccentricity of the lower back-up roller 4B, based on those accepted values. The deviation $\Delta S_E$ [mm] corresponding to each of these amplitudes can be represented by the following expression.

$$\Delta S_E = \Delta S_{ET} + \Delta S_{EB} \tag{4}$$

$$\Delta S_{ET} = \sum_{n=1}^{3} \{A_{Tn} \cdot \cos(n \cdot \theta_T) + B_{Tn} \cdot \sin(n \cdot \theta_T)\} \tag{5}$$

$$\Delta S_{EB} = \sum_{n=1}^{3} \{A_{Bn} \cdot \cos(n \cdot \theta_B) + B_{Bn} \cdot \sin(n \cdot \theta_B)\} \tag{6}$$

With the foregoing process, the eccentricity sensor 12 serves to calculate the amplitudes $A_{Tn}$, $B_{Tn}$, $A_{Bn}$ and $B_{Bn}$ of the eccentricity as the eccentricity of the upper or the lower back-up roller 4T or 4B.

Next, the depression operating unit 13 serves to accept the amplitudes $A_{Tn}$, $B_{Tn}$, $A_{Bn}$ and $B_{Bn}$ of the eccentricity of the upper or the lower back-up roller and the rotary angles $\Theta_T$ and $\Theta_B$ of the upper and lower back-up rollers sensed by the angle sensors 8T and 8B and calculate the depressing amount $\Delta S_{CW}$ of the working side and the depressing amount $\Delta S_{CD}$ of the driving side based on the accepted values. Then, the calculated values are sent to the depressor control devices 6W and 6D.

$$\Delta S_{CW} = \Delta S_{CD} = \Delta S_{CET} + \Delta S_{CEB} \tag{7}$$

-continued $$\Delta S_{CET} = \sum_{n=1}^{3} \{A_{Tn} \cdot \cos(n \cdot \theta_T + \phi_{Tn}) + B_{Tn} \cdot \sin(n \cdot \theta_T + \phi_{Tn})\} \cdot g_{Tn} \text{ [mm]} \quad (8)$$

$$\Delta S_{CEB} = \sum_{n=1}^{3} \{A_{Bn} \cdot \cos(n \cdot \theta_B + \phi_{Bn}) + B_{Bn} \cdot \sin(n \cdot \theta_B + \phi_{Bn})\} \cdot g_{Bn} \text{ [mm]} \quad (9)$$

$$g_{Tn} = \{1 + (n \cdot \omega_T \cdot T_H)^2\}^{1/2} \text{ [-]} \quad (10)$$

$$\phi_{Tn} = \tan^{-1} (n \cdot \omega_T \cdot T_H) \text{ [rad]} \quad (11)$$

$$g_{Bn} = \{1 + (n \cdot \omega_B \cdot T_H)^2\}^{1/2} \text{ [-]} \quad (12)$$

$$\phi_{Bn} = \tan^{-1} (n \cdot \omega_B \cdot T_H) \text{ [rad]} \quad (13)$$

$$\omega_T = d\theta_T/dt \text{ [rad/sec]} \quad (14)$$

$$\omega_B = d\theta_B/dt \text{ [rad/sec]} \quad (15)$$

wherein $T_H$ is a time constant of the depressors 5W and 5B [sec].

Then, the depressor control device 6W serves to drive the depressor 5W according to the depressing control amount $\Delta S_{CW}$ of the working side and control each gap of the work sides of the upper and the lower working rollers 3T and 3B. Likewise, the depressor control device 6D serves to drive the depressor 5D according to the depressing control amount $\Delta S_{CD}$ of the driving side so as to control each gap of the driving sides of the upper and the lower working rollers 3T and 3B.

As described above, the conventional eccentric roller control apparatus is arranged to eliminate only an average value of each roller eccentricity amount of the working side and the driving side. This arrangement makes it impossible to completely eliminate the adverse effect of the roller eccentricity against a product profile, resulting in the lowering of a product quality.

SUMMARY OF THE INVENTION

It is an object of the present invention to provide an eccentric roller control apparatus which is capable of eliminating the adverse effect of the eccentric roller against a product profile with high precision.

In carrying out the object, the eccentric roller control apparatus according to the present invention operates to sense the eccentricity amounts of the back-up rollers and control the depressing positions of the back-up rollers according to the sensed eccentricity and provides means for sensing each roller eccentricity of the working side and the driving side.

As the sensing means, each roller eccentricity of the working side and the driving side against the upper and the lower back-up rollers may be derived on the sensed rolling weights of the working side and the driving side and the sensed rotary angles of the upper and the lower back-up rollers. As another means, on the output side of the rolling machine, each roller eccentricity amount of the working side and the driving side may be derived on the value of a plaster thickness sensed at a ¼ length of the overall plaster width from each end of the working side and the driving side.

In operation, the roller eccentricity amounts of the working side and the driving side are sensed respectively so as to control the depressing position of the working side and the driving side as corresponding to the eccentricity amount. Hence, as compared to the conventional apparatus for eliminating an average value of the eccentricity amount, it is possible to eliminate the adverse effect caused by the eccentric rollers against the product profile with high precision.

The eccentricity amount can be calculated on the sensed rolling weights of the working side and the driving side and the sensed rotary angles of the upper and the lower back-up rollers for the purpose of implementing the means for sensing the roller eccentricity amount only by changing the software. On the output side of the rolling machine, the operation may be carried out on the sensed plaster thickness sensed at the ¼ length of the overall plaster width from each end of the working side and the driving side. This design remarkably simplifies the calculating process, though it needs two plaster thickness gauges.

DESCRIPTION OF THE PREFERRED EMBODIMENT

Figure 1:
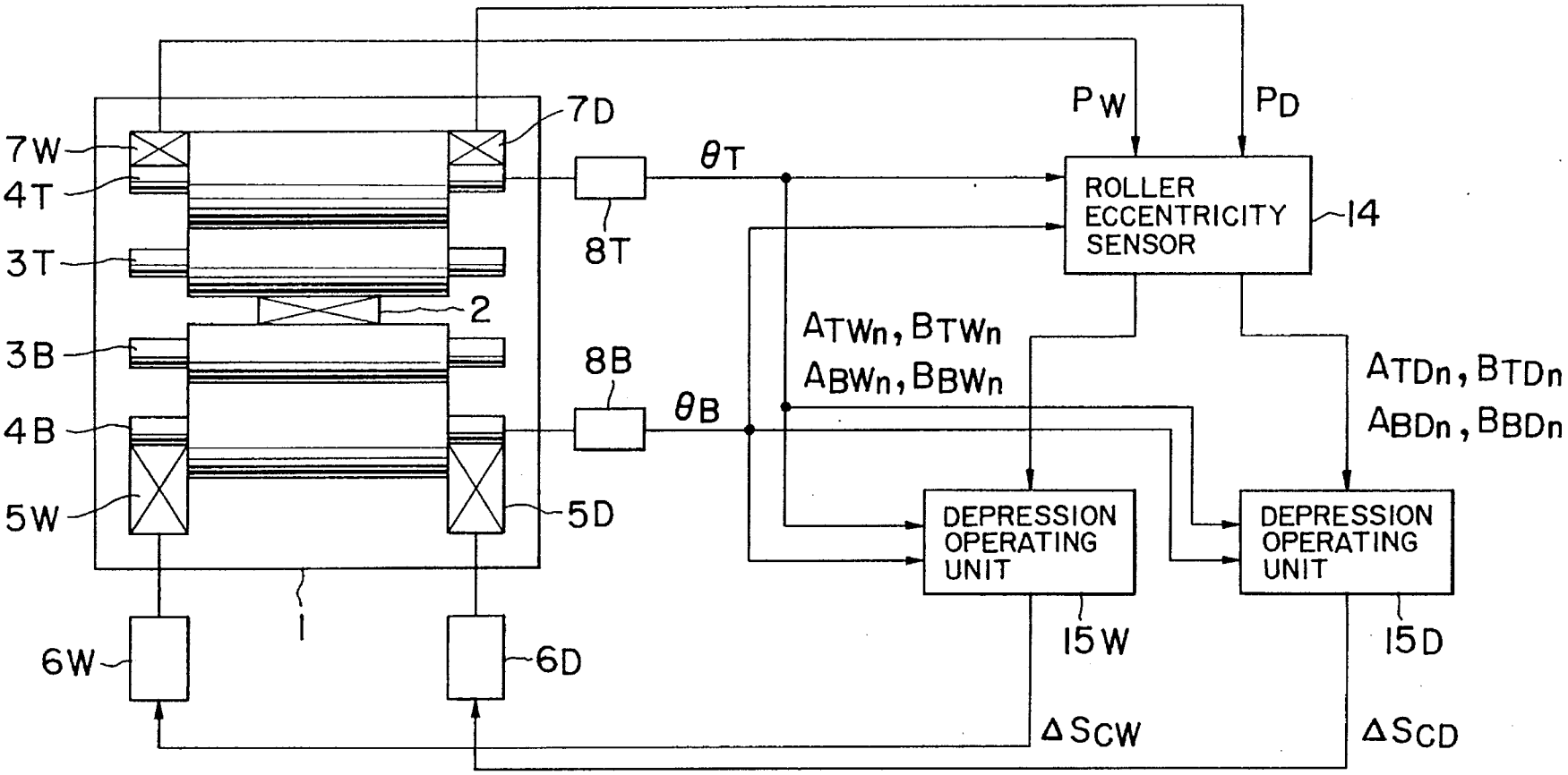
FIG. 1 is a block diagram showing an eccentric roller control apparatus according to an embodiment of the invention and a rolling machine controlled by the apparatus.
Figure 3:
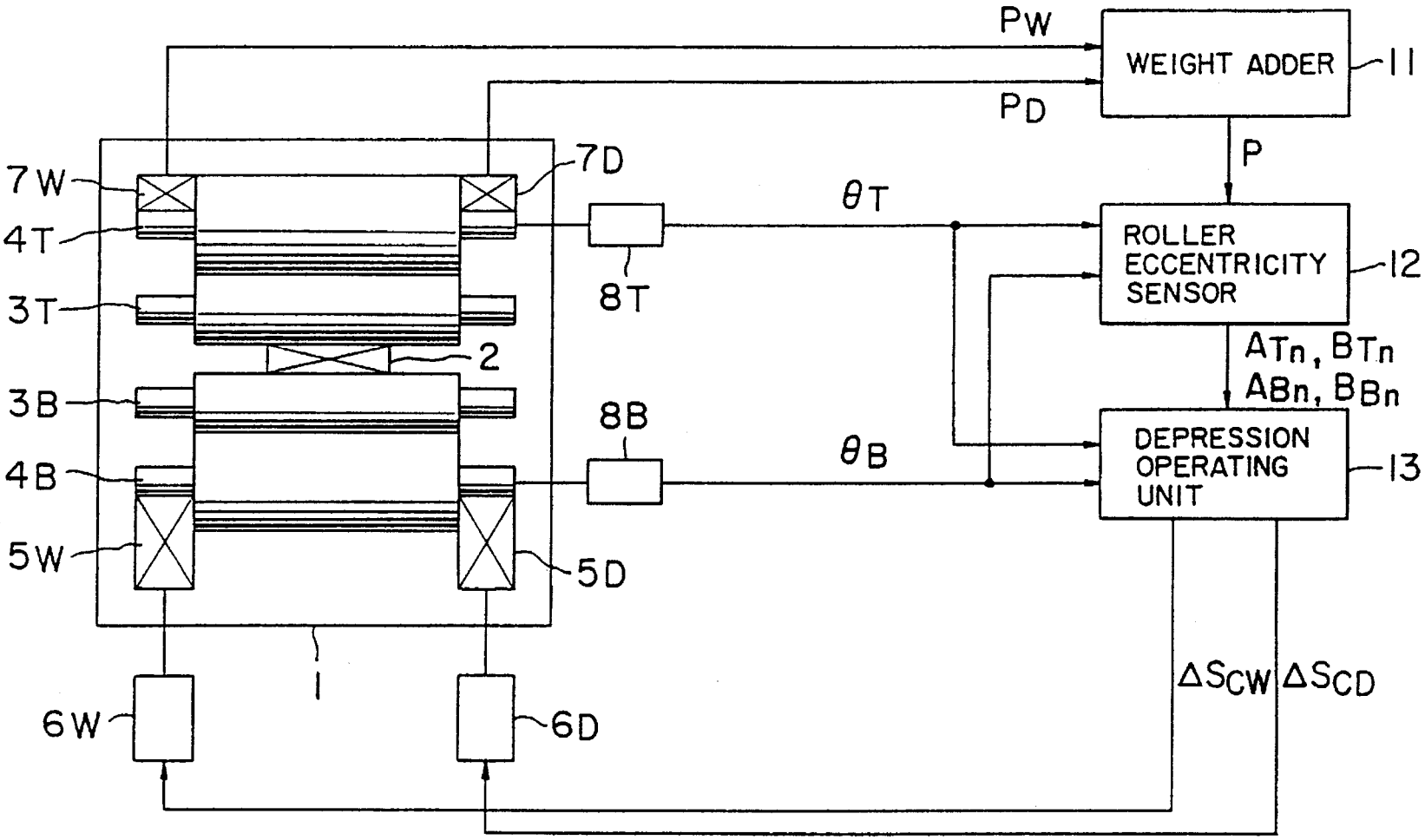
FIG. 3 PRIOR ART
FIG. 3 is a block diagram showing the conventional eccentric roller control apparatus and a rolling machine controlled by the apparatus.
Figure 4:
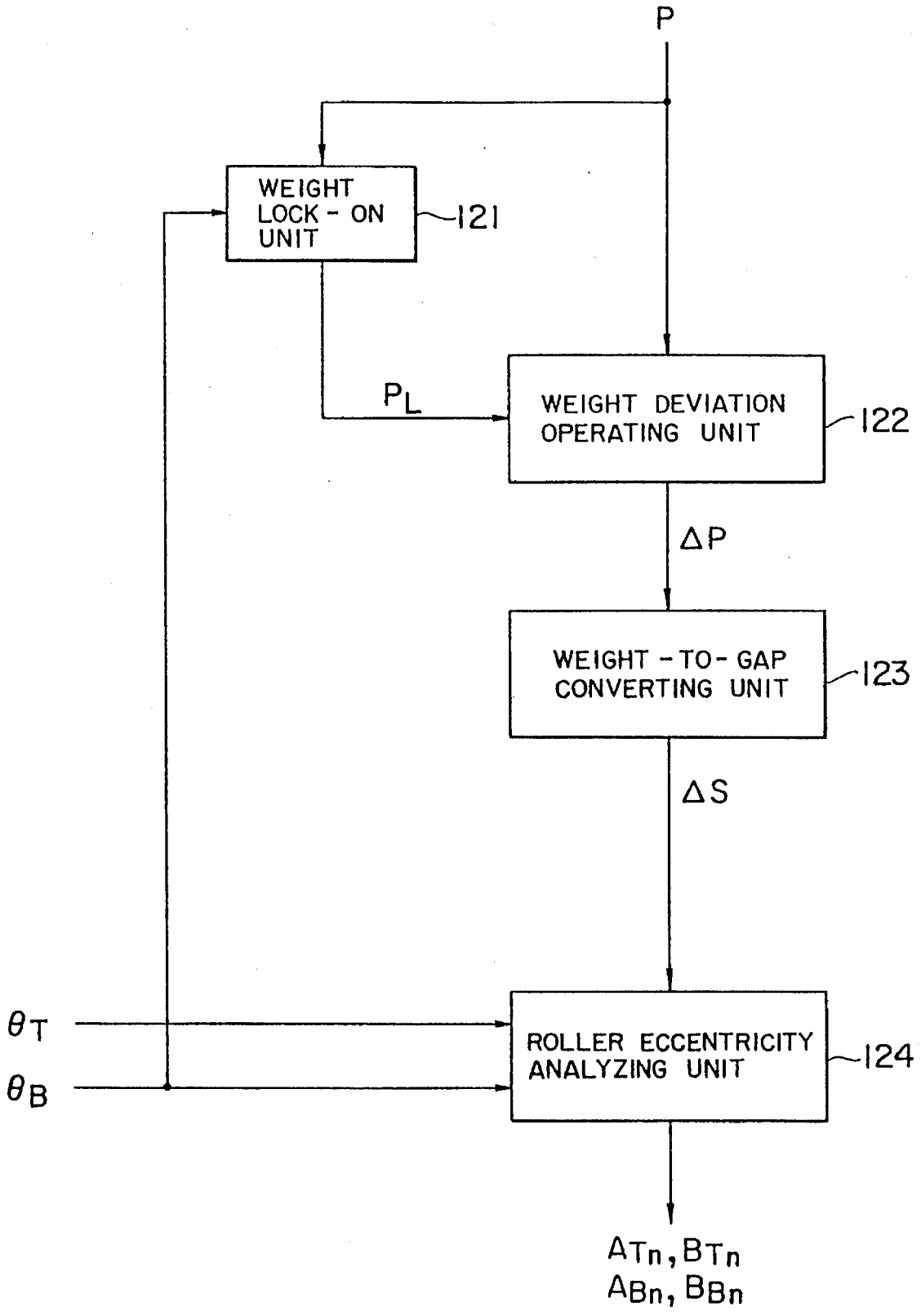
FIG. 4 PRIOR ART
FIG. 4 is a block diagram showing a main component of the conventional eccentric roller control apparatus shown in FIG. 3.

FIG. 1 is a block diagram showing an embodiment of this invention connected to a rolling machine to be controlled by this embodiment. As shown, the output signals of the rolling weight sensors 7W, 7D and the output signals of the angle sensors 8T, 8B are supplied to the roller eccentricity sensor 14. The conventional roller eccentricity sensor 12 shown in FIG. 3 serves to calculate an averaged value of the eccentricity amounts of the working side and the driving side. On the other hand, the roller eccentricity sensor 14 of this embodiment serves to calculate each roller eccentricity amount of the working side and the driving side. Based on the calculated roller eccentricity amount, a depression operating unit 15W serves to calculate the depression of the working side and supply the result to a depression control device 6W. The depression calculating unit 15D serves to calculate the depression of the driving side and supply the result to a depressor control device 6D.

Figure 2:
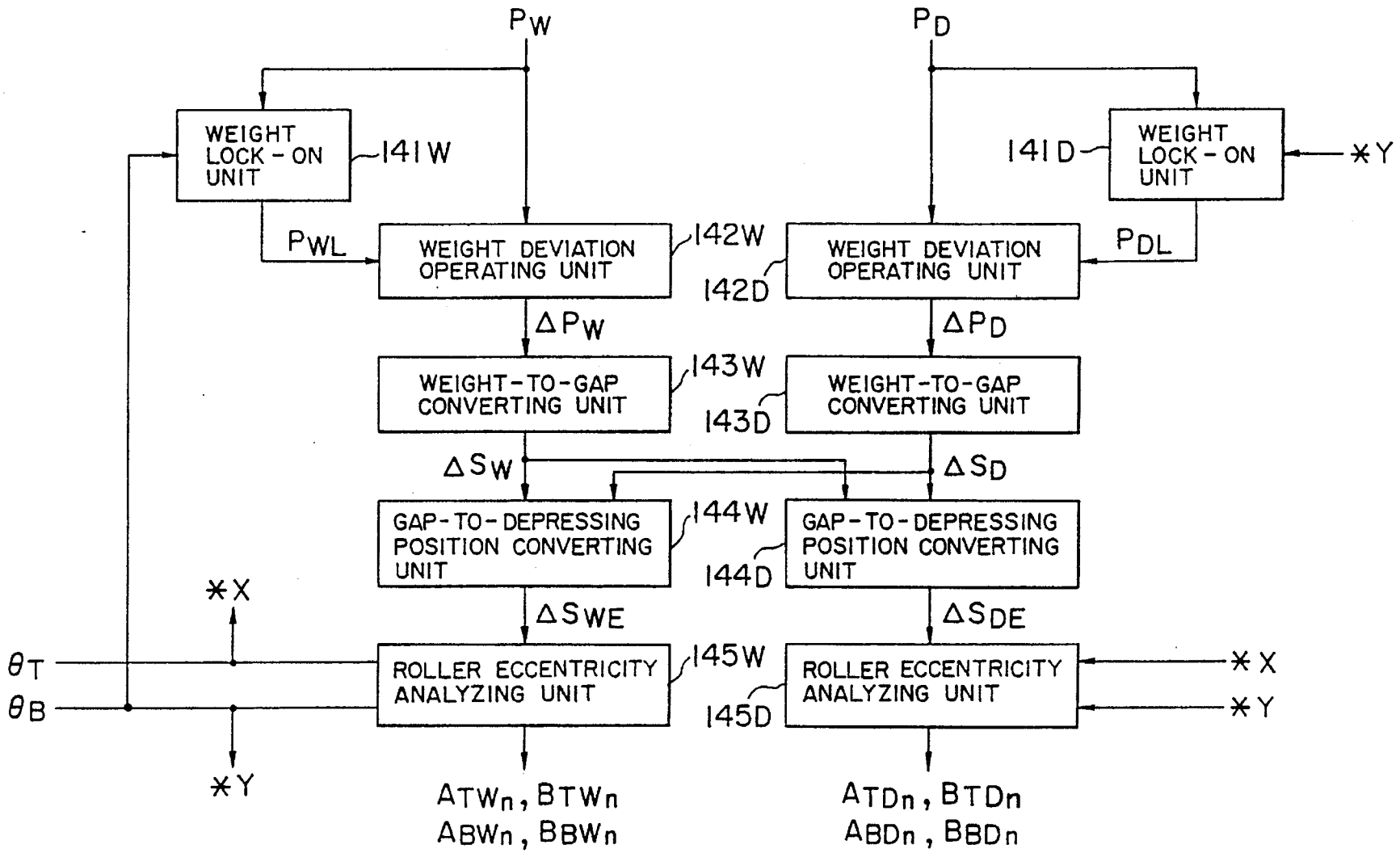
FIG. 2 is a block diagram showing a main component of the eccentric roller control apparatus shown in FIG. 1.

FIG. 2 is a block diagram showing a detailed arrangement of a roller eccentricity sensor 14. As shown, this sensor is largely divided into processing systems for the working side and the driving side. That is, the processing system for the working side is arranged to have a weight lock-on unit 141W for storing the rolling weights at the rotary angles of the lower back-up roller 4B and calculating an average value of the rolling weights, a weight deviation operating unit 142W for calculating a deviation between the average value and the rolling weight before averaging, a weight-to-gap converting unit 143W for calculating a gap deviation corresponding to the calculated weight deviation, a gap-to-depressing location converting unit 144W for calculating a deviation of the depressing position as being interlocked with the gap deviation of the opposite side, and a roller eccentricity analyzing unit 145W for calculating the roller eccentricity as an amplitude corresponding the depressing-position deviation to the outputs of the angle sensors 8T and 8B. Likewise, the processing system for the driving side is arranged to have a weight lock-on unit 141D, a weight deviation operating unit 142D, a weight-to-gap converting unit 143D, a gap-to-depressing position converting unit 144D and a roller eccentricity analyzing unit 145D.

The operation of this embodiment arranged as above will be described with respect to the different arrangement from the conventional apparatus.

The roller eccentricity sensor 14 serves to calculate each of the amplitudes $A_{TWn}$, $B_{TWn}$, $A_{BWn}$, $B_{BWn}$, $A_{TDn}$, $B_{TDn}$, $A_{BDn}$, $A_{BDn}$ and $B_{BDn}$ as each roller eccentricity of the working side and the driving side, based on the rolling weight $P_W$ of the working side, the rolling weight $P_D$ of the driving side, a rotary angle $\Theta_T$ of the upper back-up roller 4T and a rotary angle $\Theta_B$ of the lower back-up roller 4B.

In this case, the weight lock-on unit 141W serves to calculate an average value $P_{WL}$ during one rotation of the lower back-up roller 4B from the sensing start time of the roller eccentricity (referred to as a lock-on weight on the working side).

The weight deviation operating unit 142W read the rolling weight $P_W$ and the lock-on weight $P_{WL}$ and derives the weight deviation $\Delta P_W$ of the working side on the basis of the following expression.

$$\Delta P_W = P_W - P_{WL} \tag{16}$$

The weight-to-gap converting unit 143W serves to derive a working-side gap deviation $\Delta S_W$ based on the working-side weight deviation $\Delta P_W$ by the following expression.

$$\Delta S_W = -(M_W + m_W).\Delta P_W/(M_W.m_W) \tag{17}$$

wherein $M_W$ is M/2 and $m_W$ is m/2.

Likewise, the weight lock-on unit 141D serves to derive the average value $P_{DL}$ during one rotation of the lower back-up roller 4B from the sensing start of the roller eccentricity (the value being referred to as a driving-side lock-on weight), based on the rolling weight $P_D$ of the driving side and the rotary angle $\Theta_B$ of the lower back-up roller 4B.

The weight deviation operating unit 142D serves to read the rolling weight $P_D$ of the driving side and the lock-on weight $P_{DL}$ and derive the driving-side weight deviation $\Delta P_D$ by the following expression.

$$\Delta P_D = P_D - P_{DL} \tag{18}$$

The weight-to-gap converting unit 143D serves to derive the driving-side gap deviation $\Delta S_D$ based on the driving-side weight deviation $\Delta P_D$ by using the following expression.

$$\Delta S_D = -(M_D + m_D).\Delta P_D/(M_D.m_D) \tag{19}$$

wherein $M_D$ is M/2 and $m_D$ is m/2.

Next, the gap-to-depressing position converting unit 144W serves to derive the working-side depressing-position deviation $\Delta S_{WE}$, based on the gap deviation $\Delta S_W$ of the working side and the gap deviation $\Delta S_D$ of the driving side by using the following expression.

$$\Delta S_{WE} = (L/W_{ROLL} + ½).\Delta S_W - (L/W_{ROLL} - ½).\Delta S_D \tag{20}$$

wherein L is a distance between a center of the work-side depressor 5W and a center of the drive-side depressor 5D and $W_{ROLL}$ is a width of the upper work roller 3T and the lower work roller 3B.

Similarly, the gap-to-depressing position converting unit 144D serves to derive the driving-side depressing-position deviation $\Delta S_{DE}$, based on the gap deviation $\Delta S_D$ of the driving side and the gap deviation $\Delta S_W$ of the working side by using the following expression.

$$\Delta S_{DE} = (L/W_{ROLL} + ½).\Delta S_D - (L/W_{ROLL} - ½).\Delta S_W \tag{21}$$

Then, the roller eccentricity analyzing unit 145W serves to accept the working side depressing-position deviation $\Delta S_{WE}$ and the rotary angles $\Theta_T$ and $\Theta_B$ of the upper and the lower back-up rollers and perform the fast Fourier transformation with respect to the accepted values for deriving amplitudes $A_{TWn}$ (n-degree cosine component) and $B_{TWn}$ (n-degree sine component) of the working-side roller eccentricity of the upper back-up roller 4T and amplitudes $A_{BWn}$ and $B_{BWn}$ of the eccentricity of the lower back-up roller 4B. The eccentricity $\Delta S_{WE}$ corresponding to each of those amplitudes is represented by the following expression.

$$\Delta S_{WE} = \Delta S_{WET} + \Delta S_{WEB} \tag{22}$$

$$\Delta S_{WET} = \sum_{n=1}^{3} \{A_{TWN} \cdot \cos(n \cdot \theta_T) + B_{TWn} \cdot \sin(n \cdot \theta_T)\} \tag{23}$$

$$\Delta S_{WEB} = \sum_{n=1}^{3} \{A_{BWn} \cdot \cos(n \cdot \theta_B) + B_{BWn} \cdot \sin(n \cdot \theta_B)\} \tag{24}$$

Likewise, the roller eccentricity analyzing unit 145D serves to accept the driving-side depressing position deviation $\Delta S_{DE}$ and the rotary angles $\Theta_T$ and $\Theta_B$ of the upper and the lower back-up rollers sensed by the angle sensors 8T and 8B and perform the fast Fourier transformation with respect to those accepted values for deriving amplitudes $A_{TDn}$ (n-degree cosine component) and $B_{TDn}$ (n-degree sine component) of the driving-side roller eccentricity of the upper back-up roller 4T and amplitudes $A_{BDn}$ and $B_{BDn}$ of the eccentricity of the lower back-up roller 4B. The eccentricity $\Delta S_{DE}$ corresponding to each of these amplitudes can be represented by the following expression.

$$\Delta S_{DE} = \Delta S_{DET} + \Delta S_{DEB} \tag{25}$$

$$\Delta S_{DET} = \sum_{n=1}^{3} \{A_{TDN} \cdot \cos(n \cdot \theta_T) + B_{TDn} \cdot \sin(n \cdot \theta_T)\} \tag{26}$$

$$\Delta S_{DEB} = \sum_{n=1}^{3} \{A_{BDn} \cdot \cos(n \cdot \theta_B) + B_{BDn} \cdot \sin(n \cdot \theta_B)\} \tag{27}$$

Next, the depression operating unit 15W serves to accept the amplitudes $A_{TWn}$, $B_{TWn}$, $A_{BWn}$ and $B_{BWn}$ of the working-side eccentricity of the upper and the lower back-up rollers and the rotary angles $\Theta_T$ and $\Theta_B$ of the upper and the lower back-up rollers and to derive a depression amount $\Theta S_{CW}$ of the working side by the following expression. Then, the depression amount $\Delta S_{CW}$ is supplied to the depression control device 6W.

$$\Delta S_{CW} = \Delta S_{CWET} + \Delta S_{CWEB} \tag{28}$$

$$\Delta S_{CWET} = \sum_{n=1}^{3} \{A_{TWn} \cdot \cos(n \cdot \theta_T + \phi_{Tn}) + B_{TWn} \cdot \sin(n \cdot \theta_T + \phi_{Tn})\} \cdot g_{Tn} \tag{29}$$

$$\Delta S_{CWEB} = \sum_{n=1}^{3} \{A_{BWn} \cdot \cos(n \cdot \theta_B + \phi_{Bn}) + B_{BWn} \cdot \sin(n \cdot \theta_B + \phi_{Bn})\} \cdot g_{Bn} \tag{30}$$

Likewise, the depression operating unit 15D serves to accept the amplitude $A_{TDn}$ and $B_{TDn}$ and the amplitudes $A_{BDn}$ and $B_{BDn}$ of the driving-side eccentricity of the upper and the lower back-up rollers and the rotary angles $\Theta_T$ and $\Theta_B$ of the upper and the lower back-up rollers and derive the depression control amount $\Delta S_{CD}$ of the driving side by using the following expression. The derived value $\Delta S_{CD}$ is supplied to the depressor control device 6D.

$$\Delta S_{CD} = \Delta S_{CDET} + \Delta S_{CDEB} \tag{31}$$

$$\Delta S_{CDET} = \sum_{n=1}^{3} \{A_{TDn} \cdot \cos(n \cdot \theta_T + \phi_{Tn}) + B_{TDn} \cdot \sin(n \cdot \theta_T + \phi_{Tn})\} \cdot g_{Tn} \tag{32}$$

-continued $$\Delta S_{CDEB} = \sum_{n=1}^{3} \{A_{BDn} \cdot \cos(n \cdot \theta_B + \phi_{Bn}) + B_{BDn} \cdot \sin(n \cdot \theta_B + \phi_{Bn})\} \cdot g_{Bn} \quad (33)$$

As set forth above, according to this embodiment, the roller eccentricity sensor 14 serves to derive each amplitude of the eccentricity of the upper and the lower back-up rollers. Then, the depression operating unit 15W serves to calculate the depression control amount $\Delta S_{CW}$ of the working side and the depression operating unit 15D serves to calculate the depression control amount $\Delta S_{CD}$ of the driving side. This results in being able to control each roller eccentricity of the working side and the driving side independently.

According to the present embodiment, based on the sensed value of each rolling weight of the working side and the driving side, each roller eccentricity of the working side and the driving side against the upper and the lower back-up rollers are arranged to be derived. Instead, it is possible to derive the roller eccentricity based on the value of a plaster thickness sensed at a ¼ length of an overall plaster width from each end of the working side and the driving side, on the output side of the rolling machine. This results in remarkably simplifying the operating process.

As is obvious from the above description, the eccentric roller control apparatus according to this invention is arranged to sense the roller eccentricity of the working side and the driving side and control the depressing position of the working side and the driving side as corresponding to these sensed eccentricity values. The arrangement makes it possible to eliminate the adverse effect of the roller eccentricity against the product profile with high precision.

What is claimed is:

1. A roller eccentricity sensor for producing eccentricity amplitude signals for use in an eccentric roller control apparatus, comprising:

a working side weight lock-on unit receiving first rotary angle signals indicating rotary angles of a lower back-up roller and working side rolling weight signals indicating working side rolling weights of an upper back-up roller, the working side weight lock-on unit producing a working side lock-in weight signal based on the working side rolling weight signals for one cycle of first rotary angle signals;

a driving side weight lock-on unit receiving second rotary angle signals indicating rotary angles of the upper back-up roller and driving side rolling weight signals indicating driving side rolling weights of the upper back-up roller, the driving side lock-on unit producing a driving side lock-in weight signal based on the driving side rolling weight signals for one cycle of second rotary angle signals;

a working side weight deviation calculation unit receiving the working side rolling weight signals and the working side lock-in weight signal and producing working side weight deviation signals as differences between the working side rolling weight signals and the working side lock-in weight signal;

a driving side weight deviation calculation unit receiving the driving side rolling weight signals and the driving side lock-in weight signal and producing driving side weight deviation signals as differences between the driving side rolling weight signals and the driving side lock-in weight signal;

a working side weight-to-gap converting unit receiving the working side weight deviation signals and producing working side gap deviation signals therefrom;

a driving side weight-to-gap converting unit receiving the driving side weight deviation signals and producing driving side gap deviation signals therefrom;

a working side gap-to-depressing location converting unit receiving the working side and driving side gap deviation signals and producing working side depressing position deviation signals based on the working side and driving side gap deviation signals;

a driving side gap-to-depressing location converting unit receiving the working side and driving side gap deviation signals and producing driving side depressing position deviation signals based on the working side and driving side gap deviation signals;

a working side roller eccentricity analyzing unit receiving the working side depressing position deviation signals and the first and second rotary angle signals and producing working side eccentricity amplitude signals for the upper and lower back-up rollers; and a driving side roller eccentricity analyzing unit receiving the driving side depressing position deviation signals and the first and second rotary angle signals and producing driving side eccentricity amplitude signals for the upper and lower back-up rollers.

* * * * *